United States Patent [19]

Knodel

[11] Patent Number: 4,914,921

[45] Date of Patent: Apr. 10, 1990

[54] REFRIGERATION METHOD AND APPARATUS USING AQUEOUS LIQUID SEALED COMPRESSOR

[75] Inventor: Bryan D. Knodel, Plainfield, Ill.

[73] Assignee: CBI Research Corporation, Plainfield, Ill.

[21] Appl. No.: 232,869

[22] Filed: Aug. 16, 1988

[51] Int. Cl.[4] ..... F25D 3/00

[52] U.S. Cl. ..... 62/59; 62/114; 62/123; 62/434; 62/502; 417/68

[58] Field of Search ..... 62/59, 123, 114, 533, 62/534, 434, 502, 512, 271, 467, 498; 417/68 X

[56] References Cited

U.S. PATENT DOCUMENTS

| | | | |
|---|---|---|---|
| 2,440,930 | 5/1948 | Camilli et al. | 62/114 X |
| 2,751,762 | 6/1956 | Colton | 62/114 X |
| 3,247,678 | 4/1966 | Mohlman | 62/185 X |
| 3,257,818 | 6/1966 | Papapanu | 62/185 X |
| 3,258,933 | 7/1966 | Osborne | 62/114 X |
| 3,277,659 | 10/1966 | Sylvan et al. | 62/502 X |
| 3,299,654 | 1/1967 | Leonard, Jr. | 62/502 X |
| 3,833,315 | 9/1974 | Fitch | 417/68 |
| 4,078,392 | 3/1978 | Kestner | 62/434 X |
| 4,498,844 | 2/1985 | Bissell et al. | 417/68 |
| 4,551,070 | 11/1985 | Olsen et al. | 417/68 |
| 4,554,797 | 11/1985 | Goldstein | 62/123 X |
| 4,596,120 | 6/1986 | Knodel et al. | 62/123 X |

FOREIGN PATENT DOCUMENTS 809294 2/1959 United Kingdom .

*Primary Examiner*—Lloyd L. King

*Attorney, Agent, or Firm*—Marshall, O'Toole, Gerstein, Murray & Bicknell

[57] ABSTRACT

An improved refrigeration cycle in which a refrigerant vapor is compressed, condensed and then evaporated for cooling purposes by direct contact with a liquid to be cooled, the improvement comprising feeding a refrigerant vapor to an aqueous liquid sealed compressor; feeding compressor sealing aqueous liquid to the compressor; compressing the refrigerant vapor in the compressor and removing a mixture of compressed refrigerant vapor and aqueous liquid from the compressor; separating aqueous liquid from the refrigerant vapor and returning the aqueous liquid to the compressor; condensing the refrigerant vapor to a liquid, directly contacting the liquefied refrigerant with a liquid to be cooled; and, returning the refrigerant vapor to the compressor.

41 Claims, 3 Drawing Sheets

REFRIGERATION METHOD AND APPARATUS USING AQUEOUS LIQUID SEALED COMPRESSOR

This invention relates to refrigeration apparatus and methods. More particularly, this invention is concerned with a closed vapor or loop refrigeration cycle which uses an aqueous liquid sealed compressor and a direct contact evaporator for water chilling and/or ice production.

BACKGROUND OF THE INVENTION

In a direct contact evaporator for chilling water and/or ice production, water and liquefied refrigerant are brought into direct contact whereby the water is chilled or partially frozen as energy is absorbed by the vaporizing liquefied refrigerant. Direct contact heat transfer allows high rates of energy transfer with small temperature differences by minimizing thermal resistance and maximizing the surface area for energy transfer.

Selection of the refrigerant used in this type of direct contact evaporator is crucial to its performance. Many refrigerants including R-11, R-12, R-22 and R-502 form hydrates when used in direct contact heat transfer with water. A hydrate is a substance in which refrigerant molecules are trapped within the crystal structure of water. Hydrates often form at temperatures above the normal freezing point of water. Typically, approximately 30% by weight of a hydrate is liquid refrigerant. Therefore, the formation of hydrates in a direct contact evaporator represents a consumption of refrigerant which must be replaced for the system to continue operation. Refrigerants are available, however, which do not form hydrates. Refrigerant R-114, C-318 mixtures of R-12 and R-114, n-butane, isobutane and others are all non-hydrate forming. A direct contact evaporator operating with these refrigerants can operate continuously on a fixed charge without requiring a large inventory of refrigerant.

Several problems are associated with the use of conventional lubricated or non-lubricated compression equipment where a direct contact evaporator is used. In these systems, a suction separator is required to minimize the flow of water droplets from the direct contact evaporator into the compressor suction line. In addition, the presence of water vapor in the suction line to the compressor can cause corrosion problems in conventional nonlubricated equipment or it can emulsify the oil in oil lubricated compressors. Also, with oil lubricated equipment an oil recovery system is required on the compressor discharge to minimize the loss of oil to the water or ice in the direct contact evaporator. Finally, non-lubricated compression equipment is typically more expensive and less efficient than lubricated equipment. There is accordingly a need for an improved refrigeration cycle including novel apparatus and methods for producing refrigeration using a direct contact evaporator and a compressor which is lubricated and sealed with an aqueous liquid.

SUMMARY OF THE INVENTION

According to one aspect of the invention there is provided an improvement in a refrigeration apparatus in which a refrigerant vapor is compressed, condensed and then evaporated for cooling purposes, the improvement comprising an aqueous liquid sealed compressor; conduit means for feeding refrigerant vapor to the compressor; conduit means for feeding compressor sealing aqueous liquid to the compressor; conduit means for removing a mixture of refrigerant vapor and aqueous liquid from the compressor; and means to separate the aqueous liquid from the refrigerant and return the aqueous liquid to the compressor.

The refrigeration apparatus can include a refrigerant vapor condenser. Conduit means for feeding refrigerant vapor, from which aqueous liquid has been separated, can be included to feed the refrigerant vapor to the condenser. Alternatively, conduit means can be included to feed the mixture of refrigerant vapor and aqueous liquid from the compressor to a refrigerant vapor condenser to condense the refrigerant and conduit means also can be included for removing a mixture of aqueous liquid and liquid refrigerant from the condenser and feeding the mixture to a separator to separate the aqueous liquid from the liquid refrigerant. Additionally, conduit means can be included to return the aqueous liquid to the compressor.

According to another aspect of the invention there is provided an improved refrigeration method in which a refrigerant vapor is compressed, condensed and then evaporated for cooling purposes, the improvement comprising feeding a refrigerant vapor to an aqueous liquid sealed compressor; feeding compressor sealing aqueous liquid to the compressor; compressing the refrigerant vapor in the compressor and removing a mixture of compressed refrigerant vapor and aqueous liquid from the compressor; and separating aqueous liquid from the refrigerant vapor and returning the aqueous liquid to the compressor.

According to a further aspect of the invention refrigeration apparatus is provided comprising an evaporator; an aqueous liquid sealed compressor; a compressor sealing aqueous liquid; a refrigerant substantially insoluble in the compressor sealing aqueous liquid; conduit means for feeding refrigerant vapor from the evaporator to the compressor; a receiver/separator; conduit means for feeding compressor sealing aqueous liquid from the receiver/separator to the compressor; a heat exchanger; conduit means for feeding a mixture of refrigerant vapor and aqueous liquid from the compressor to the heat exchanger to cool the aqueous liquid and condense the refrigerant vapor to liquid; and conduit means for feeding a mixture of liquid refrigerant and cooled aqueous liquid from the heat exchanger to the receiver/separator wherein the liquid refrigerant and cooled aqueous liquid stratify by gravity as separate liquid layers; and conduit means for feeding liquid refrigerant from the receiver/separator to the evaporator.

The refrigeration apparatus desirably is in the form of a closed loop.

The refrigeration apparatus can also include conduit means to feed a third liquid to be cooled to the evaporator for direct contact with refrigerant therein; and conduit means for removing cooled third liquid from the evaporator. The compressor sealing aqueous liquid and the third liquid can be the same liquid. The refrigerant used in the apparatus desirably is one which does not form a hydrate with the compressor sealing aqueous liquid.

The apparatus can also include, in the conduit means for feeding liquid refrigerant to the evaporator, a heat conducting, desirably metallic, expansion nozzle through which the liquid refrigerant can be fed into the evaporator.

More specifically, the invention provides refrigeration apparatus comprising an evaporator; an aqueous liquid sealed compressor; a refrigerant; a compressor sealing aqueous liquid; conduit means for feeding refrigerant vapor from the evaporator to the compressor; a first heat exchanger for cooling the compressor sealing aqueous liquid; conduit means for feeding cooled compressor sealing aqueous liquid from the first heat exchanger to the compressor; a liquid separator; conduit means for feeding a mixture of refrigerant vapor and aqueous liquid from the compressor to the liquid separator; conduit means for feeding aqueous liquid from the separator to the first heat exchanger; a second heat exchanger for cooling and condensing the refrigerant vapor; conduit means for feeding refrigerant vapor from the separator to the second heat exchanger; and conduit means for feeding liquid refrigerant from the second heat exchanger to the evaporator.

The refrigeration method in a more detailed embodiment comprises feeding refrigerant vapor to an aqueous liquid sealed compressor to compress the vapor; removing a mixture of compressed refrigerant vapor and compressor sealing aqueous liquid from the compressor and separating the refrigerant vapor from the aqueous liquid; cooling the aqueous liquid and returning it to the compressor; condensing the separated refrigerant vapor to liquid; feeding the liquid refrigerant through a nozzle to thereby obtain refrigeration and produce refrigerant vapor; and returning the so-produced refrigerant vapor to the compressor.

Another embodiment of the refrigeration method comprises feeding refrigerant vapor to an aqueous liquid sealed compressor to compress the vapor; removing a mixture of compressed refrigerant vapor and compressor sealing aqueous liquid from the compressor and cooling the mixture to condense the refrigerant to liquid and form cooled compressor sealing aqueous liquid; separating the refrigerant liquid and the cooled sealing aqueous liquid; feeding the cooled sealing aqueous liquid to the compressor; feeding the liquid refrigerant through a nozzle to thereby obtain refrigeration and produce refrigerant vapor; and returning the so-produced refrigerant vapor to the compressor.

The refrigeration method can also include contacting a third liquid with the refrigerant fed through the nozzle to thereby cool the third liquid and produce refrigerant vapor. The third liquid can be an aqueous liquid and be cooled to form ice particles. Furthermore, it can be the same liquid as the compressor sealing aqueous liquid.

The refrigerant used in the apparatus is desirably one which does not form a hydrate with the compressor sealing aqueous liquid.

Specific refrigerants which can be used are butane, isobutane, a chloro or fluoro substituted butane or isobutane, octofluorocyclobutane, a chloro and/or fluoro substituted methane or ethane, dichlorotetrafluoroethane, or a mixture of dichlorotetrafluoroethane and dichlorodifluoromethane.

DETAILED DESCRIPTION OF THE DRAWINGS

Figure 1:
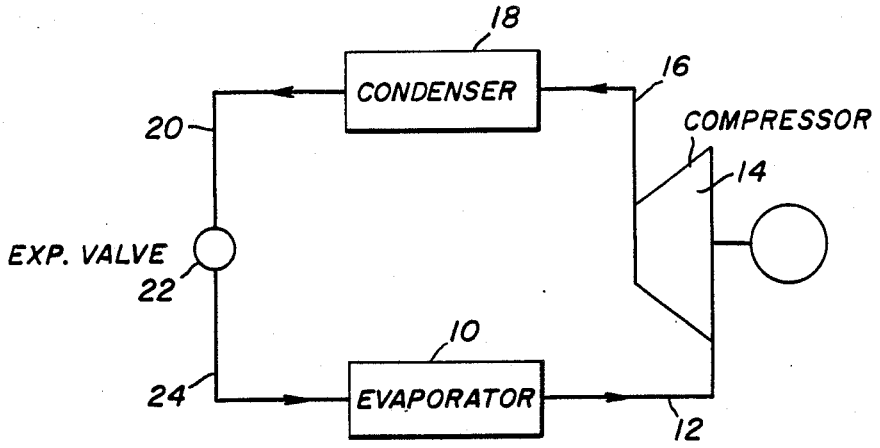
FIG. 1 (PRIOR ART)
FIG. 1 is a schematic drawing of a prior art refrigeration cycle.

A typical prior art vapor compression refrigeration cycle is shown in FIG. 1. In this cycle, refrigerant vapor evolves in the evaporator 10 as a result of heat transfer into the liquid refrigerant. The refrigerant vapor is fed by conduit 12 to the compressor 14 where it is compressed. The compressed vapor exits the compressor and is fed by conduit 16 to the condenser 18 where it is condensed by heat transfer out of the refrigerant. The condensed liquid refrigerant is fed by conduit 20 through the expansion device 22 from which it is expanded with lowering of the temperature of the refrigerant prior to it reentering the evaporator 10.

Oil is generally used in the compressor 14 to lubricate moving parts and, in some cases, is used to assist in compressing the gas. This and similar systems require an oil separator and recovery systems to handle the oil and minimize movement of oil onto heat transfer surfaces in the condenser 18 and evaporator 10 where the oil deters heat transfer performance Also, since moisture in the system results in the formation of refrigerant hydrates at the expansion device, thus blocking the refrigerant flow, measures are taken to eliminate moisture from the refrigeration loop.

Figure 2:
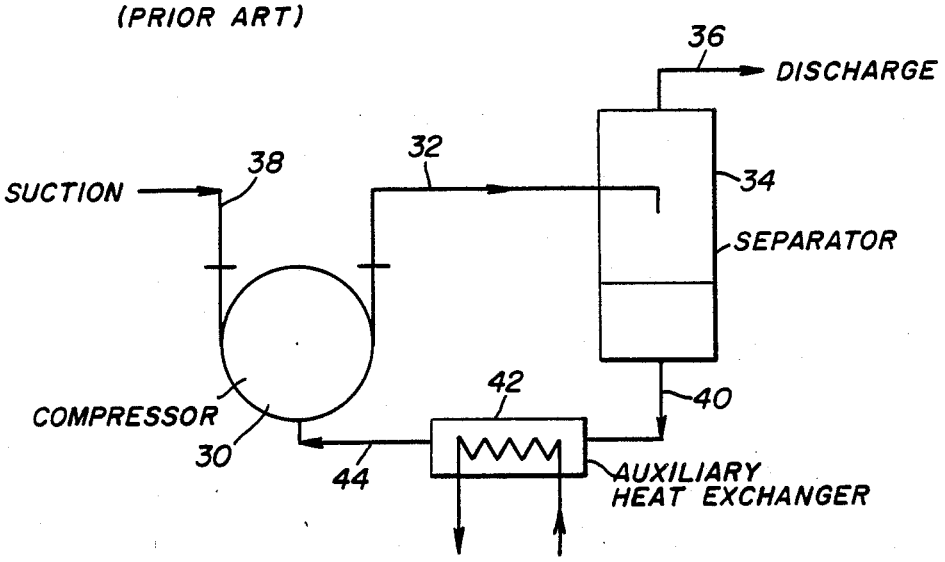
FIG. 2 (PRIOR ART)
FIG. 2 is a schematic drawing of a prior art gas compression system using a liquid sealed compressor.

FIG. 2 illustrates a prior art gas compression, non-refrigeration cycle using an aqueous liquid sealed compressor 30 to assist in compressing the gas. The aqueous liquid can be only water or an aqueous solution. In the process of compressing the gas a portion of the aqueous sealing liquid exits the unit with the compressed gas and is fed by conduit 32 to separator 34 which is typically used to recover the sealing water from the gas. The aqueous liquid collects at the bottom of separator 34 and the gas vapor collects at the top. The compressed gas is removed by conduit 36. If the sealing water is recirculated to the compressor 30 in a closed loop, the aqueous sealing liquid can be removed from separator 34 by conduit 40 and fed to auxiliary heat exchanger 42 where the heat of compression is removed. Then the cooled sealing liquid is fed by conduit 44 to compressor 30. This aqueous liquid sealed compression system has not been used previously in a refrigeration cycle. Additionally, the aqueous sealing liquid serves to lubricate the compressor.

Figure 3:
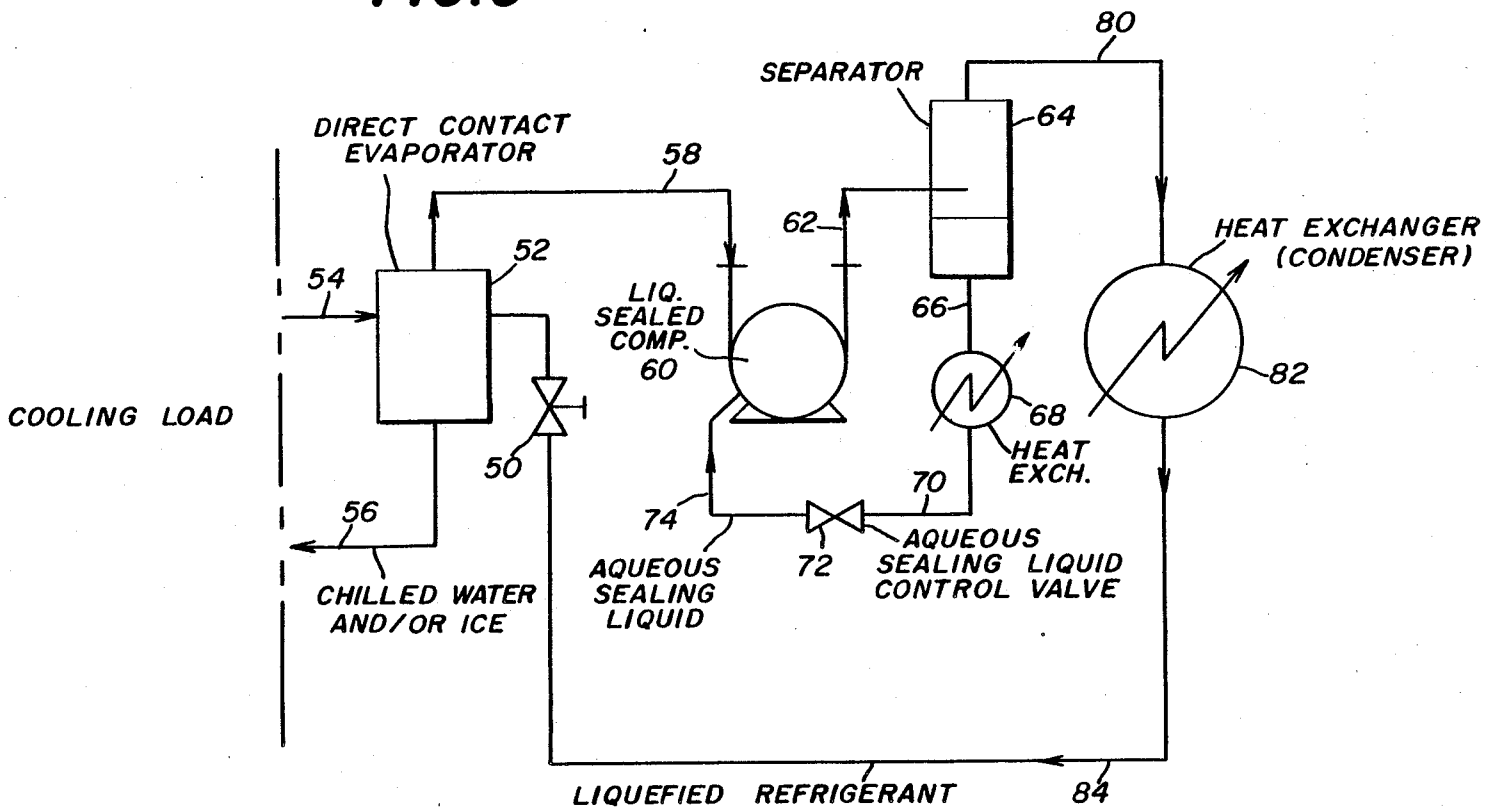
FIG. 3 is a schematic drawing of a refrigeration cycle according to the invention using a liquid sealed compressor and in which the refrigerant is used to directly contact water to chill it and/or produce ice.

FIG. 3 illustrates one embodiment of a direct contact refrigeration cycle provided by the invention using an aqueous liquid sealed compressor to compress the refrigerant. In this system, a liquefied refrigerant is fed by conduit 84 through expansion valve 50 into a direct contact evaporator 52 containing an aqueous cooling liquid to be chilled and/or partially converted to ice particles. The warm aqueous liquid is fed by conduit 54 into evaporator 52 where it is directly contacted with the liquefied refrigerant which is vaporized by heat exchange with the aqueous liquid. The cooled aqueous liquid, which may also contain ice particles, is removed from evaporator 52 by conduit 56 and used for refrigeration purposes following which it is fed to conduit 54 to be recycled to evaporator 52.

Refrigerant vapor containing water vapor is removed from evaporator 52 by conduit 58 and is fed to liquid sealed compressor 60. The compressed refrigerant vapor containing compressor aqueous sealing liquid is withdrawn from compressor 60 through conduit 62 and fed to separator 64.

The hot compressor aqueous sealing liquid collects in the bottom space of separator 64 and it is removed therefrom through conduit 66 and fed to heat exchanger 68 in which it is cooled. Cooled compressor sealing aqueous liquid is withdrawn from heat exchanger 68 through conduit 70 and fed through control valve 72 to conduit 74 which returns the sealing aqueous liquid to compressor 60.

The high pressure refrigerant vapor is removed from the upper space of separator 64 by means of conduit 80 and fed to heat exchanger 82 in which it is cooled to a liquid. The liquefied refrigerant is withdrawn from heat exchanger 82 by conduit 84 and fed to expansion valve 50 from which cold refrigerant vapor and liquid exit into evaporator 52.

The aqueous liquid sealed compressor used in the refrigeration cycle illustrated by FIG. 3 overcomes the problems involved with prior systems.

The aqueous liquid sealed compressor can handle wet gas streams in the form of water vapor or even aqueous liquid droplets without failure. Since there is no oil the entire oil recovery system can be eliminated. In addition, this equipment is simple, typically consisting of only one moving part, and requires low maintenance.

An aqueous liquid sealed compressor can be incorporated directly into a vapor compression refrigeration cycle with a discharge separator between the compressor and condenser or heat exchanger to remove most of the aqueous sealing liquid. The aqueous sealing liquid and refrigerant vapors are then cooled in separate heat exchangers to remove the heat of compression from the aqueous sealing liquid and to condense the refrigerant.

Figure 4:
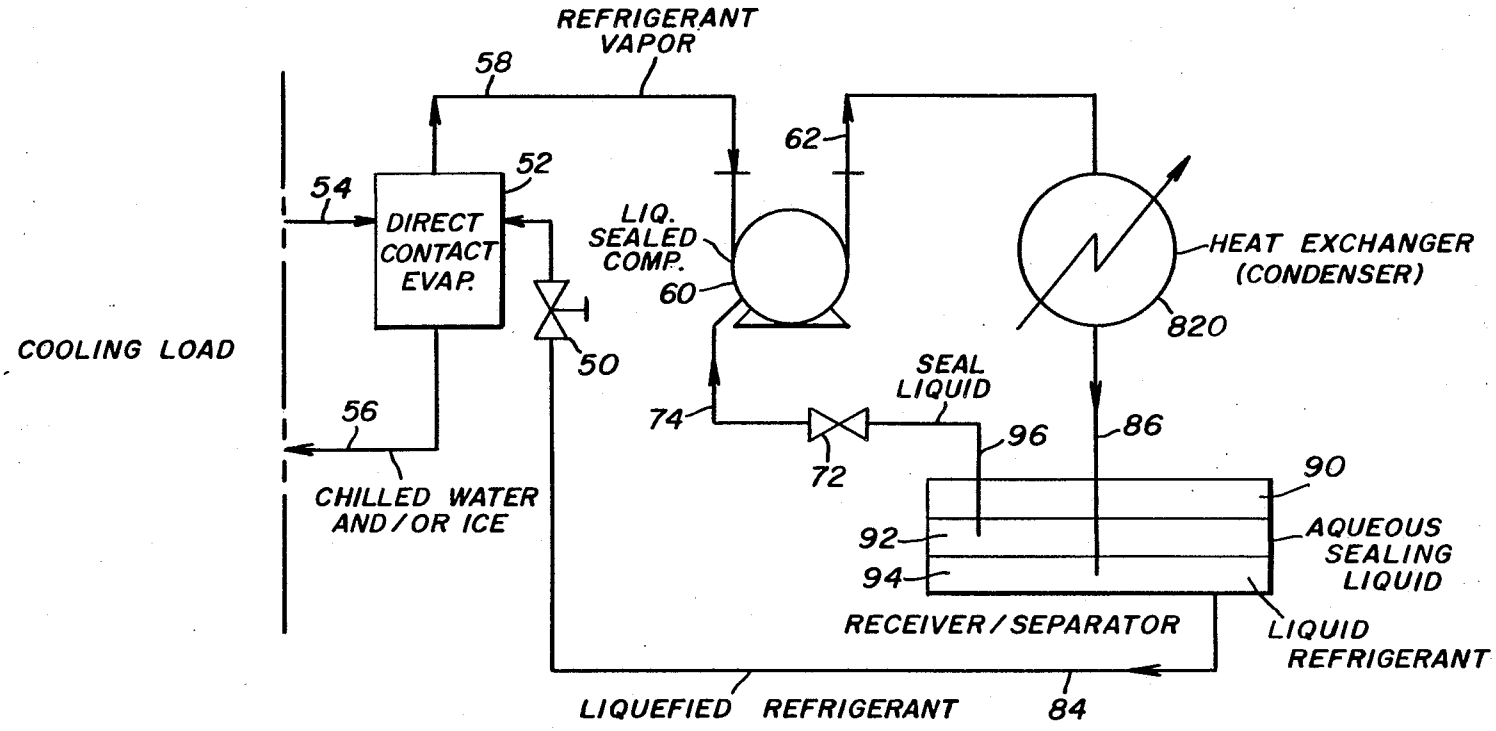
FIG. 4 is a schematic drawing of a second embodiment of a refrigeration cycle according to the invention using a liquid sealed compressor and in which the refrigerant is used to directly contact water to chill it and/or produce ice.

FIG. 4 illustrates a second embodiment of the invention and will be seen to be a simplified configuration which significantly enhances the system performance. Those parts of the refrigeration cycle illustrated by FIG. 4 which are common to the refrigeration cycle of FIG. 3 will not be described again but only the different or modified portions will be explained.

As seen in FIG. 4, the two phase mixture of compressed refrigerant vapor and compressor aqueous sealing liquid are fed by conduit 62 directly to heat exchanger 820 (like heat exchanger 82) where the refrigerant vapors are condensed and the heat of compression removed from the sealing aqueous liquid simultaneously. The presence of the aqueous sealing liquid in the refrigerant vapor enhances the heat transfer as the liquid carries additional heat from the vapor to the walls of the heat exchanger tubes.

The cooled mixture of liquefied refrigerant and compressor sealing aqueous liquid is removed from heat exchanger 820 through conduit 86 and fed to receiver/-separator 90 where the two liquids are separated by gravity into two layers with the aqueous layer 92 on top of the liquefied refrigerant layer 94. The aqueous sealing liquid is withdrawn from receiver/separator 90 through conduit 96 and fed through control valve 72 to conduit 74 and thereby returned to compressor 60. The liquefied refrigerant is withdrawn from receiver/-separator 90 by conduit 84, expanded through valve 50 and the resulting cold refrigerant vapor and liquid fed into direct contact with the aqueous liquid in evaporator 52 as previously described.

The liquid refrigerant removed from the receiver/-separator 90 is saturated with water. Therefore, the design of the expansion device must be such that blockage does not occur due to freezing. A rapid expansion device in which the pressure is dropped suddenly just prior to mixing with the water in the direct contact evaporator provides tee desired trouble free operation. A metallic nozzle with an orifice can be used to flash the water saturated refrigerant. The warm high pressure refrigerant on one side of the orifice provides sufficient heat to prevent ice-up as the refrigerant expands.

The refrigerant and the compressor sealing aqueous liquid used in the embodiments of FIGS. 3 and 4 should be selected such that they do not react chemically and are substantially immisible or insoluble to minimize the refrigerant charge. Various refrigerants can be incorporated in the invention including butane, isobutane, a chloro or fluoro substituted derivative of butane or isobutane and particularly octofluorocyclobutane, a chloro and/or fluoro substituted derivative of methane or ethane and especially dichlorotetrafluoroethane or a mixture of dichlorotetrafluoroethane and dichlorodifluoromethane.

Any suitable aqueous sealing liquid can be employed in the apparatus and method. Some such aqueous liquids are pure water, solutions of water and sodium chloride, and mixtures of water and a glycol such as ethylene glycol. It is especially advantageous for the sealing liquid and the aqueous liquid, i.e., the third liquid, which is chilled in evaporator 52 to be the same.

The foregoing detailed description has been given for clearness of understanding only, and no unnecessary limitations should be understood therefrom, as modifications will be obvious to those skilled in the art.

What is claimed is:

1. Refrigeration apparatus comprising:
- an evaporator;
- an aqueous liquid sealed compressor;
- a refrigerant;
- a compressor sealing aqueous liquid;
- conduit means for feeding refrigerant vapor from the evaporator to the compressor;
- a first heat exchanger for cooling the compressor sealing aqueous liquid;
- conduit means for feeding cooled compressor sealing aqueous liquid from the first heat exchanger to the compressor;
- a liquid separator;
- conduit means for feeding a mixture of refrigerant vapor and aqueous liquid from the compressor to the liquid separator;
- conduit means for feeding aqueous sealing liquid from the separator to the first heat exchanger;
- a second heat exchanger for cooling and condensing the refrigerant vapor;
- conduit means for feeding refrigerant vapor from the separator to the second heat exchanger; and
- conduit means for feeding liquid refrigerant from the second heat exchanger to the evaporator.

2. Refrigeration apparatus according to claim 1 in the form of a closed loop.

3. Refrigeration apparatus according to claim 1 including:
- conduit means to feed a third liquid to be cooled to the evaporator for direct contact with refrigerant therein; and conduit means for removing cooled third liquid from the evaporator.

4. Refrigeration apparatus according to claim 3 in which the compressor sealing aqueous liquid and the liquid to be cooled in the evaporator are the same.

5. Refrigeration apparatus comprising:

an evaporator;

an aqueous liquid sealed compressor;

a compressor sealing aqueous liquid;

a refrigerant substantially insoluble in the compressor sealing aqueous liquid;

conduit means for feeding refrigerant vapor from the evaporator to the compressor;

a receiver/separator;

conduit means for feeding compressor sealing aqueous liquid from the receiver/separator to the compressor;

a heat exchanger;

conduit means for feeding a mixture of refrigerant vapor and aqueous sealing liquid from the compressor to the heat exchanger to cool the aqueous liquid and condense the refrigerant vapor to liquid;

conduit means for feeding a mixture of liquid refrigerant and cooled aqueous sealing liquid from the heat exchanger to the receiver/separator wherein the liquid refrigerant and cooled aqueous sealing liquid stratify by gravity as separate liquid layers; and conduit means for feeding liquid refrigerant from the receiver/separator to the evaporator.

6. Refrigeration apparatus according to claim 5 in the form of a closed loop.

7. Refrigeration apparatus according to claim 5 including:

conduit means to feed a third liquid to be cooled to the evaporator for direct contact with refrigerant therein; and conduit means for removing cooled third liquid from the evaporator.

8. Refrigeration apparatus according to claim 7 in which the compressor sealing aqueous liquid and the third liquid to be cooled in the evaporator are the same liquid.

9. Refrigeration apparatus according to claim 1, 2, 3 or 4 in which the refrigerant does not form a hydrate with the compressor sealing aqueous liquid.

10. Refrigeration apparatus according to claim 1, 2, 3 or 4 in which the refrigerant is butane, isobutane, a chloro or fluoro substituted butane or isobutane, octofluorocyclobutane, a chloro and/or fluoro substituted methane or ethane, dichlorotetrafluoroethane, or a mixture of dichlorotetrafluoroethane and dichlorodifluoromethane.

11. Refrigeration apparatus according to claim 1, 2, 3 or 4 including, in the conduit means for feeding liquid refrigerant to the evaporator, a heat conducting expansion nozzle through which the liquid refrigerant is fed into the evaporator.

12. A refrigeration method comprising:

feeding refrigerant vapor to an aqueous liquid sealed compressor to compress the vapor;

removing a mixture of compressed refrigerant vapor and compressor sealing aqueous liquid from the compressor and separating the refrigerant vapor from the aqueous liquid;

cooling the aqueous sealing liquid and returning it to the compressor;

condensing the separated refrigerant vapor to liquid;

feeding the liquid refrigerant through a nozzle to thereby obtain refrigeration and produce refrigerant vapor; and returning the so-produced refrigerant vapor to the compressor.

13. The refrigeration method of claim 12 in a closed loop.

14. The refrigeration method of claim 12 including contacting a third liquid with the refrigerant fed through the nozzle to thereby cool the third liquid and produce refrigerant vapor.

15. The refrigeration method of claim 14 in which the compressor sealing aqueous liquid and the third liquid to be cooled are the same liquid.

16. The refrigeration method of claim 14 in which the third liquid is an aqueous liquid.

17. The refrigerant method of claim 16 in which the aqueous liquid is cooled and ice particles are formed.

18. A refrigeration method comprising:

feeding refrigerant vapor to an aqueous liquid sealed compressor to compress the vapor;

removing a mixture of compressed refrigerant vapor and compressor sealing aqueous liquid from the compressor and cooling the mixture to condense the refrigerant to liquid and form cooled compressor sealing aqueous liquid;

separating the refrigerant liquid and the cooled aqueous sealing liquid;

feeding the cooled aqueous sealing liquid to the compressor;

feeding the liquid refrigerant through a nozzle to thereby obtain refrigeration and produce refrigerant vapor; and returning the so-produced refrigerant vapor to the compressor.

19. The refrigeration method of claim 18 in a closed loop.

20. The refrigeration method of claim 18 including contacting a third liquid with the refrigerant fed through the nozzle to thereby cool the third liquid and produce refrigerant vapor.

21. The refrigeration method of claim 20 in which the compressor sealing aqueous liquid and the third liquid to be cooled are the same liquid.

22. The refrigerant method of claim 20 in which the third liquid is an aqueous liquid.

23. The refrigeration method of claim 22 in which the aqueous liquid is cooled and ice particles are formed.

24. The refrigeration method of claim 12, 13, 14, 15, 16 or 17 in which the refrigerant does not form a hydrate with the compressor sealing aqueous liquid.

25. The refrigeration method of claim 12, 13, 14, 15, 16 or 17 in which the nozzle is heat conducting.

26. The refrigeration method of claim 12, 13, 14, 15, 16 or 17 in which the refrigerant is butane, isobutane, a chloro or fluoro substituted butane or isobutane, octofluorocyclobutane, a chloro and/or fluoro substituted methane or ethane, dichlorotetrafluoroethane, or a mixture of dichlorotetrafluoroethane and dichlorodifluoromethane.

27. A refrigeration method comprising:

feeding refrigerant vapor to an aqueous liquid sealed compressor to compress the vapor;

removing a mixture of compressed refrigerant vapor and compressor sealing aqueous liquid from the compressor and separating the refrigerant vapor from the aqueous liquid;

cooling the aqueous sealing liquid and returning it to the compressor;

condensing the separated refrigerant vapor to liquid;

feeding the liquid refrigerant to an evaporator to thereby obtain refrigeration and produce refrigerant vapor; and returning the so-produced refrigerant vapor to the compressor.

28. The refrigeration method of claim 27 in a closed loop.

29. The refrigeration method of claim 27 including contacting a third liquid with the refrigerant in the evaporator to thereby cool the third liquid and produce refrigerant vapor.

30. The refrigerant method of claim 29 in which the compressor sealing aqueous liquid and the third liquid to be cooled are the same liquid.

31. The refrigeration method of claim 29 in which the third liquid is an aqueous liquid.

32. The refrigerant method of claim 31 in which the aqueous liquid is cooled and ice particles are formed.

33. A refrigeration method comprising:

feeding refrigerant vapor to an aqueous liquid sealed compressor to compress the vapor;

removing a mixture of compressed refrigerant vapor and compressor sealing aqueous liquid from the compressor and cooling the mixture to condense the refrigerant to liquid and form cooled compressor sealing aqueous liquid;

separating the refrigerant liquid and the cooled aqueous sealing liquid;

feeding the cooled aqueous sealing liquid to the compressor;

feeding the liquid refrigerant to an evaporator to thereby obtain refrigeration and produce the refrigerant vapor; and returning the so-produced refrigerant vapor to the compressor.

34. The refrigeration method of claim 33 in a closed loop.

35. The refrigeration method of claim 33 including contacting a third liquid with the refrigerant in the evaporator to thereby cool the third liquid and produce refrigerant vapor.

36. The refrigeration method of claim 35 in which the compressor sealing aqueous liquid and the third liquid to be cooled are the same liquid.

37. The refrigerant method of claim 35 in which the third liquid is an aqueous liquid.

38. The refrigeration method of claim 37 in which the aqueous liquid is cooled and ice particles are formed.

39. The refrigeration method of claim 27 or 33 in which the refrigerant does not form a hydrate with the compressor sealing aqueous liquid.

40. The refrigeration method of claim 27 or 33 in which the refrigerant is fed to the evaporator through a nozzle.

41. The refrigeration method of claim 27 or 33 in which the refrigerant is butane, isobutane, a chloro or fluoro substituted butane or isobutane, octofluorocyclobutane, a chloro and/or fluoro substituted methane or ethane, dichlorotetrafluoroethane, or a mixture of dichlorotetrafluoroethane and dichlorodifluoromethane.

* * * * *